United States Patent [19]

Griffin

[11] Patent Number: 4,669,522

[45] Date of Patent: Jun. 2, 1987

[54] MANUFACTURE OF ROTARY DRILL BITS

[75] Inventor: Nigel D. Griffin, Whitminster, England

[73] Assignee: NL Petroleum Products Limited, Stonehouse, England

[21] Appl. No.: 846,784

[22] Filed: Apr. 1, 1986

[30] Foreign Application Priority Data

Apr. 2, 1985 [GB] United Kingdom ..... 8508621

[51] Int. Cl.[4] ..... B22D 19/14

[52] U.S. Cl. ..... 164/97; 164/80; 419/6

[58] Field of Search ..... 164/97, 80; 419/6, 7

[56] References Cited

U.S. PATENT DOCUMENTS 4,485,147 11/1984 Nishino et al. ..... 419/6 X

FOREIGN PATENT DOCUMENTS 55-117543 9/1980 Japan ..... 164/97

*Primary Examiner*—Kuang Y. Lin

*Attorney, Agent, or Firm*—William E. Johnson, Jr.

[57] ABSTRACT

A method of making a rotary drill bit comprises forming a hollow mould for moulding at least a portion of the bit body, packing at least a part of the mould with powdered matrix material, and infiltrating the material with a metal alloy in a furnace to form a matrix, the alloy being a copper based alloy containing phosphorus and being selected to provide an infiltration temperature which is not greater than 850° C. and preferably not greater than 750° C.

15 Claims, 1 Drawing Figure

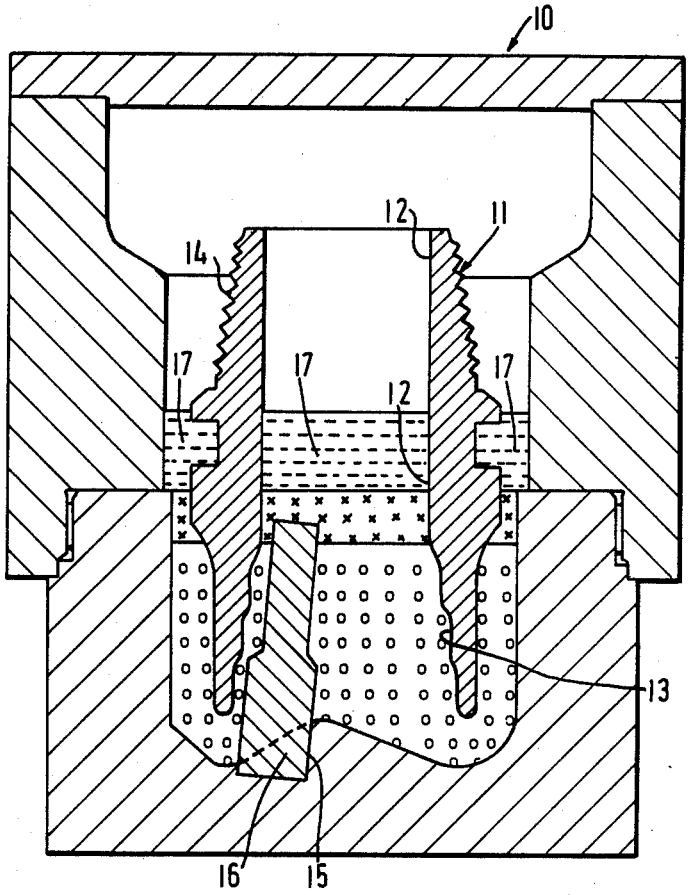
10
12
11
14
17
17
12
17
13
16
15

MANUFACTURE OF ROTARY DRILL BITS

BACKGROUND OF THE INVENTION

The invention relates to rotary drill bits for use in drilling or coring deep holes in subsurface formations.

In particular, the invention is applicable to rotary drill bits of the kind comprising a bit body having an external surface on which are mounted a plurality of cutting elements for cutting or abrading the formation, and an inner passage for supplying drilling fluid to one or more nozzles at the external surface of the bit. The nozzles are so located at the surface of the bit body that drilling fluid emerging from the nozzles flows past the cutting elements, during drilling, so as to cool and/or clean them.

Although not essential to the present invention, the cutting elements may be in the form of so-called "preform" cutting elements in the shape of a tablet, often circular, having a superhard cutting face formed of polycrystalline diamond or other superhard material.

In one commonly used method of making rotary drill bits of the above mentioned type, the bit body is formed by a powder metallurgy process. In this process a hollow mould is first formed, for example from graphite, in the configuration of the bit body or a part thereof. The mould is packed with powdered material, such as tungsten carbide, which is then infiltrated with a metal alloy, such as a copper alloy, in a furnace so as to form a hard matrix.

Using conventional infiltration alloys, the furnace temperature required to form the matrix is usually of the order of 1000° C. to 1170° C. and this leads to certain disadvantages. For example, conventional polycrystalline diamond preforms are only thermally stable up to a temperature of 700°-750° C. For this reason the preform cutting elements, or cutting structures incorporating the elements, are normally mounted in the bit body after it has been infiltrated. The interior surface of the mould is therefore normally suitably shaped to provide surfaces to which the cutting elements may be subsequently brazed, or to provide sockets to receive studs or carriers to which the cutting elements are bonded. The subsequent mounting of the cutting elements on the body is a time-consuming and costly process, and may involve serious technical difficulties. The cutting elements and/or cutting structures must also be made sufficiently accurately to fit the pockets in the bit body, and this also adds to the cost.

There are now available certain polycrystalline diamond preforms which are thermally stable up to conventional infiltration temperatures, typically about 1100° C. However, the use of such thermally stable preforms gives rise to further problems, particularly with regard to ensuring that the cutting elements are securely mounted on the bit body with sufficient exposure for optimum cutting action.

Conventionally, before the matrix is formed, the mould is partly filled with a steel blank, the matrix being formed around the blank. After the matrix forming process, a further steel piece is welded onto a projecting portion of the blank and is shaped and formed with a thread to provide the threaded shank by means of which the drill bit may be connected to the drill string. The provision of the threaded shank must be effected after the matrix has been formed since the high infiltration temperature can cause metallurgical deterioration of the steel blank.

In order to avoid the above mentioned disadvantages, it has been proposed to use a low temperature infiltration alloy such that the infiltration temperature is below about 700° C., i.e. is at a temperature where conventional preforms are thermally stable. One such low temperature alloy has comprised 45% silver, 15% copper, 16% zinc and 24% cadmium. However, the use of such alloy has not proved commercially acceptable, not least because of its high cost.

The present invention therefore sets out to provide a method of making a drill bit using a low temperature infiltrant which may overcome the disadvantages of the known methods referred to above.

SUMMARY OF THE INVENTION

According to the invention there is provided a method of making a rotary drill bit of the first-mentioned type by a powder metallurgy process, the method comprising forming a hollow mould for moulding at least a portion of the bit body, packing at least part of the mould with powdered matrix material, and infiltrating the material with a metal alloy in a furnace to form a matrix, the alloy being a copper based alloy containing phosphorus and being selected to provide an infiltration temperature which is not greater than 850° C. Preferably the infiltration temperature is not greater than 750° C.

The comparatively low infiltration temperature according to the invention has the advantage that conventional preforms of the kind first described above may withstand the furnace temperature and may thus be located in the mould and incorporated in the bit body during formation of the matrix. Furthermore, the steel blank which is first introduced into the mould may be a one-piece element which may also be pre-machined to provide the threaded shank on the finished drill bit. Both these advantages may reduce significantly the cost of manufacture of the bit.

Although, as previously mentioned, thermally stable preforms may, in any case, be positioned in the mould at normal infiltration temperatures (1100° C.-1170° C.), the method of the present invention may also be used advantageously with such thermally stable preforms. This is because, at the lower infiltration temperature according to the present invention, the difference in coefficient of thermal expansion between the preforms and the matrix material has less deleterious effect than it does at higher temperatures. Thus, using the lower temperature method of the invention, the preform cutting elements may be more securely embedded in the matrix material owing to less stress occurring at the interface between the materials during cooling of the bit body from the infiltration temperature.

In the method according to the invention the alloy may be an essentially two-element copper-phosphorus alloy. The alloy may be of eutectic, or near-eutectic composition. For example, the alloy may comprise approximately 8.4% phosphorus in a copper base.

In a further alternative the infiltration alloy may be a copper-phosphorus-tin alloy. For example, the alloy may comprise approximately 85% copper, up to 10% tin and up to 10% phosphorus.

Another form of low temperature infiltration alloy which may be used in the invention is a copper-phosphorus-silver aloy having a copper base, up to 8% of phosphorus and up to 20% of silver. However, the proportion of silver in the alloy is preferably something of the order of 2% in view of the high cost of silver.

BRIEF DESCRIPTION OF THE DRAWINGS

The single FIGURE is a diagrammatic vertical section through a mould showing the manufacture of a drill bit by the method according to the invention.

DETAILED DESCRIPTION OF THE PREFERRED EMBODIMENTS

Referring to the drawing, a two-part mould 10 is formed from graphite or other suitable material and has an internal configuration corresponding generally to the required surface shape of the bit body or a portion thereof. For example, the mould may be formed with elongate recesses to provide radially extending blades upstanding from the surface of the finished bit. In the case where cutting elements are to be incorporated in the bit body during formation thereof, the internal surface of the mould may also be shaped to provide locations to receive the cutting elements, or cutting structures incorporating such cutting elements. The cutting elements or structures may, for example, be glued in position on the internal surface of the mould.

Alternatively, in the case where the cutting elements or cutting structures are to be mounted on the bit body after formation thereof, the surface of the mould may be formed with a plurality of sockets each of which receives a former, which formers, during formation of the matrix, define in the matrix sockets to receive the cutting elements or structures, such as studs, on which the cutting elements are mounted.

The matrix material is moulded on and within a hollow steel blank 11. The steel blank is supported in the mould 10 so that its outer surface is spaced from the inner surface of the mould. The blank has an upper cylindrical internal cavity 12 communicating with a lower diverging cavity 13. The upper portion of the blank 11 is formed with a machined external screw thread 14 which will form the threaded shank for connecting the drill bit to the drill string.

There is also provided in the mould 10, at each desired location for a nozzle in the finished bit, a socket 15 which receives one end of an elongate stepped cylindrical nozzle former 16 which extends into the mould space within the lower cavity 13 in the hollow steel blank 11.

After the insertion of the steel blank 11 into the mould, powdered matrix forming material (for example, powdered tungsten carbide) is packed around the the outside of the steel blank and within the lower diverging cavity 13 of the blank, and around the formers 16 and the formers or cutting elements mounted over the internal surface of the mould. Tungsten metal powder is then packed in part of the upper cavity 12 in the steel blank 11.

A body of infiltrant alloy is then located, as indicated at 17, above the matrix forming material both within and around the steel blank 11. In accordance with the invention, the alloy is a copper-based alloy containing phosphorus and is selected to provide an infiltration temperature which is not greater than 850° C. and is preferably not greater than 750° C.

A suitable alloy is a two-element copper-phosphorus alloy which is of eutectic or near-eutectic composition. For example the alloy may comprise approximately 8.4% phosphorus in a copper base.

Another suitable form of alloy is a copper-phosphorus-tin alloy, for example comprising approximately 85% copper, up to 10% tin and up to 10% phosphorus.

Another form of low temperature infiltration alloy which is suitable is a copper-phosphorus-silver alloy having a copper base, up to 8% of phosphorus and up to 20% of silver. Preferably however the proportion of silver is of the order of 2% to reduce cost.

After the matrix forming material and infiltrant have been packed into the mould, the filled mould is placed in a furnace and heated to cause the alloy to fuse and infiltrate the matrix forming material in known manner. It has been found preferable to carry out the infiltration in the furnace in an atmosphere of dry hydrogen, for example hydrogen having a dew point of approximately −30° C. Alternatively, the infiltration may be carried out in a vacuum furnace.

In accordance with the invention, the alloy fuses and infiltrates the matrix powder at a temperature not greater than 850° C., which is considerably less than the infiltration temperature using the infiltration alloys employed hitherto.

After removal of the bit body from the mould, the formers 16 are removed from the body and the sockets so formed are then ready to receive nozzle assemblies. Similarly, if formers for the cutting structures are used, such formers are also removed from the bit body and the cutting structures fitted in the normal manner. However, as previously mentioned, an important advantage of the present invention is that it may allow the cutting elements or cutting structures to be embodied in the bit body during formation of the bit body in the mould since the comparatively low temperature of infiltration removes the risk of thermal damage to the cutting elements and cutting structures and there is also less risk of damage due to thermal stresses as the bit body cools after formation.

Furthermore, in view of the lower temperature of infiltration, there is also less risk of thermal deformation and damage to the steel blank. Consequently, the threaded portion of the steel blank may be suitable for use as the threaded shank of the finished drill bit without further machining, or with only minimum machining.

In known matrix forming methods where the matrix has been formed around a steel blank, the coefficient of thermal expansion of the matrix is normally matched as closely as possible to the coefficient of thermal expansion of the steel blank so as to prevent spalling or cracking due to thermal stress. This may mean that the other characteristics, such as the hardness characteristics, of the matrix material have to be compromised. According to the present invention however, since the infiltration temperature is lower, the thermal stress is less so that the coefficient of thermal expansion of the matrix does not need to be matched so closely to the coefficient of thermal expansion of the steel blank. There is therefore more scope for selecting the matrix material according to the other desirable characteristics of the solidified matrix.

I claim:

1. A method of making a rotary drill bit comprising forming a hollow mould for moulding at least a portion of the bit body, packing at least a part of the mould with powdered matrix material, and infiltrating the material with a metal alloy in a furnace to form a matrix, the alloy being a copper based alloy containing phosphorus and being selected to provide an infiltration temperature which is not greater than 850° C.

2. A method according to claim 1, wherein the alloy is selected to provide an infiltration temperature which is not greater than 750° C.

3. A method according to claim 1, wherein the alloy is an essentially two-element copper-phosphorus alloy.

4. A method according to claim 3, wherein the alloy is substantially of eutectic composition.

5. A method according to claim 4, wherein the alloy comprises approximately 8.4% phosphorus in a copper base.

6. A method according to claim 1, wherein the alloy is a copper-phosphorus-tin alloy.

7. A method according to claim 6, wherein the alloy comprises approximately 85% copper, up to 10% tin and up to 10% phosphorus.

8. A method according to claim 1, wherein the alloy is a copper-phosphorus-silver alloy.

9. A method according to claim 8, wherein the alloy includes up to 8% phosphorus and up to 20% silver.

10. A method according to claim 9, wherein the alloy includes approximately 2% silver.

11. A method according to claim 1, wherein the infiltration in the furnace is effected in a hydrogen atmosphere.

12. A method according to claim 11, wherein the hydrogen atmosphere has a dew point not greater than −30° C.

13. A method according to claim 1, wherein the infiltration in the furnace is effected in a vacuum.

14. A method according to claim 1, including the step of locating a plurality of cutting elements on the internal surface of the hollow mould before the mould is packed with matrix material, whereby the cutting elements become secured at the surface of the finished bit body.

15. A method according to claim 1, including the step of locating a steel blank within the hollow mould, before packing the mould around part of the steel blank with powdered matrix material, the steel blank being preformed with a threaded shank which constitutes the threaded shank of the finished drill bit.

* * * * *